US007128220B2

(12) United States Patent
Baitz

(10) Patent No.: US 7,128,220 B2
(45) Date of Patent: Oct. 31, 2006

(54) BANKNOTE COMPARTMENT FOR A TILL DRAWER

(75) Inventor: Günter Baitz, Berlin (DE)

(73) Assignee: Wincor Nixdorf International GmbH, Paderborn (DE)

( * ) Notice: Subject to any disclaimer, the term of this patent is extended or adjusted under 35 U.S.C. 154(b) by 233 days.

(21) Appl. No.: 10/416,079

(22) PCT Filed: Nov. 7, 2001

(86) PCT No.: PCT/EP01/12878

§ 371 (c)(1),
(2), (4) Date: Sep. 9, 2003

(87) PCT Pub. No.: WO02/38006

PCT Pub. Date: May 16, 2002

(65) Prior Publication Data

US 2004/0027558 A1 Feb. 12, 2004

(30) Foreign Application Priority Data

Nov. 7, 2000 (DE) ..... 100 55 121

(51) Int. Cl.
*B42F 17/00* (2006.01)

(52) U.S. Cl. ..... 211/51

(58) Field of Classification Search ..... 211/51, 211/49.1, 50, 59.2, 59.3, 13.1, 10, 11
See application file for complete search history.

(56) References Cited

U.S. PATENT DOCUMENTS

| | | | | |
|---|---|---|---|---|
| 490,707 | A * | 1/1893 | Besly | 211/51 |
| 630,314 | A * | 8/1899 | Bankman et al. | 211/51 |
| 947,512 | A | 1/1910 | Sellick | |
| 1,415,170 | A * | 5/1922 | Gurney | 211/51 |
| 2,633,615 | A * | 4/1953 | Donovan | 211/51 |
| 3,892,309 | A * | 7/1975 | Coffey et al. | 206/449 |
| 6,003,690 | A | 12/1999 | Allen et al. | |

FOREIGN PATENT DOCUMENTS

| | | |
|---|---|---|
| CH | 268 991 A | 10/1950 |
| DE | 295 19 608 U1 | 3/1996 |
| DE | 197 26 838 A1 | 1/1999 |
| EP | 0 157 313 A1 | 1/1987 |
| EP | 0 924 670 A1 | 6/1999 |
| WO | WO 93/18490 | 9/1993 |

* cited by examiner

*Primary Examiner*—Sarah Purol
(74) *Attorney, Agent, or Firm*—Michaud-Duffy Group LLP

(57) ABSTRACT

The invention relates to a banknote compartment for a till drawer or the like, which is defined by a bottom, sidewalls, a rear wall and a front wall and has a covering element which extends from the rear wall over a part of the length of the compartment which is measured between the rear wall and the front wall. Said covering element comprises a holding-down clamp for banknotes, near its free edge which is at a distance from the rear wall. The clamp can be pivoted about an axis which is parallel to the bottom and the rear wall, between a pressure position, in which said clamp is pre-stressed downwards in the direction of the bottom, and a lifted release position. At least one intermediate bottom dividing the banknote compartment into superposed partial compartments is arranged between the bottom of the compartment and the covering element, parallel thereto and at a distance therefrom. Said intermediate bottom extends from the rear wall over a part of the length of the compartment.

11 Claims, 4 Drawing Sheets

BANKNOTE COMPARTMENT FOR A TILL DRAWER

CROSS-REFERENCE TO RELATED APPLICATIONS

This application is entitled to the benefit of and incorporates by reference essential subject matter disclosed in International Application No. PCT/EP01/12878 filed on Nov. 7, 2001 and German Patent Application No. 100 55 121.1 filed on Nov. 7, 2000.

FIELD OF THE INVENTION

The invention concerns a banknote compartment for a till or the like, which compartment is bounded by a compartment bottom, sidewalls, a rear wall and a forward wall and has a cover which proceeding from the rear wall extends over a portion of the compartment length as measured between the rear wall and the forward wall and which at its free end remote from the rear wall carries a hold-down clamp for banknotes, which clamp is pivotal about an axis parallel to the compartment bottom and the rear wall between a pressing position, in which it is biased downwardly in the direction toward the compartment bottom, and a lifted releasing position, and wherein further an intermediate bottom is arranged between the compartment bottom and the cover and which is arranged parallel to and spaced from the compartment bottom and the cover so as to divide the banknote compartment into partial compartments lying above one another, the intermediate wall proceeding from the rear wall and extending over a portion of the compartment length.

With the inclusion of at least one further plane in the banknote compartment and the division of it into partial compartments more place is made for additional banknotes. Thereby within relatively small space a larger number of different banknotes, check forms, receipts and the like can be orderly deposited. A till with banknote compartments according to the invention is therefore especially suited for use as a till at airports and markets near borders, at which customers to a large degree pay with money of different values.

BACKGROUND OF THE INVENTION

EP-B-157 313 shows a unit for a till with a number of banknote compartments in it. The cover is formed from an upper shell, which is insertable into the banknote containing lower shell and itself has compartments for receiving coins.

In WO93/18 490 A1 is shown a till with a square shaped housing open at a front wall and with a drawer slidable in the housing with a drawer underportion and a compartment unit. The compartment unit is slidable parallel to the sliding direction of the drawer between a first position at which it covers the bottom of the drawer underportion, and a second position in which it gives free access to the rearward bottom region of the drawer underportion.

In EP 0 924 670 A1 a unit for a till is shown which has a lowerportion with compartments for coins and over it has attached depositing places for banknotes. The depositing places for banknotes are in this case preferably formed as one or more pockets which can be fastened to the cover of the unit at the rear wall of the unit lowerportion.

In DE 197 26 838 A1 is revealed a banknote unit for a till drawer which unit is divided into several banknote compartments lying above one another, which unit is pivotable between two end positions, in the first of which the opening of the banknote unit lies behind the forward wall of the till drawer lowerportion and in the second of which the opening lies above the forward wall of the till drawer lowerportion.

In customary banknote compartments of the previously mentioned kind there appears however the problem that an intermediate bottom hinders access to the undermost partial compartment and makes difficult the depositing or removal of a banknote from the lowermost partial compartment. Moreover, in a banknote compartment of such a type only the banknotes in the uppermost compartment are held by the hold-down clamp.

The invention has therefore as its object the provision of a banknote compartment of the previously mentioned kind in which access to banknotes in the partial compartment or compartments below the intermediate floor is eased and these banknotes likewise can be held fast.

SUMMARY OF THE INVENTION

This object is solved by a banknote compartment according to the invention in that the intermediate bottom includes a fixed section connected with the rear wall and a movable section which is pivotally linked to the edge of the fixed section remotely from the rear wall for movement about an axis parallel to the bottom and to the rear wall, and in that the movable section of the intermediate bottom and the hold-down clamp are of such dimensions that the hold-down clamp in its pressing position lies with its free end on the movable section of the intermediate bottom and presses the movable section in the direction toward the compartment bottom. Thereby a spring on the movable section of the intermediate bottom can be spared with nevertheless a secure holding of the banknotes in the lower partial compartment being assured. By lifting of the movable section the banknotes contained in the lower partial compartment can be easily grasped.

To make it possible for the operating person to have quick access to banknotes the movable section of the intermediate bottom and the down holding clamp can be coupled to one another for common pivotal movement.

To increase the receiving capacity of the banknote compartment a second intermediate bottom forming further partial compartments can be arranged between the bottom and the intermediate bottom parallel to and spaced from the bottom and the intermediate bottom, which intermediate bottom proceeding from the rear wall extends over a portion of the compartment length. In this case the second intermediate bottom can be longer than the first intermediate bottom, so that the banknotes lying below the first intermediate bottom can be more easily grasped.

To facilitate access to the lower partial compartments the forward wall of the banknote compartment can be moved between a dosing position and an opening position, in which opening position access to one or more partial compartments is made free. For example the forward wall can be pivotal about an axis directed parallel to the compartment bottom or parallel to one of the sidewalls.

Similarly to the first intermediate bottom, the second intermediate bottom can include a fixed section connected to the rear wall and a movable section, which movable section is pivotal about an axis at the edge of the fixed section of the second intermediate bottom remote from the rear wall and which axis is parallel to the compartment bottom and to the rear wall. Also the movable section of the second intermediate bottom can be coupled with the hold-down clamp and the movable section of the first intermediate bottom for common pivotal movement, so that by nothing other than a pivoting of the hold-down clamp access to all of the partial compartments is made free.

To facilitate the removal of banknotes, especially from the lowermost partial compartment, a trough shaped surface can be formed in the forward portion of the banknote compartment so as to bridge the angle between the compartment bottom and the forward wall. This can be formed in a simple way by a leaf spring which is fastened with its rear end to the compartment bottom and which with its forward end lies on the inner surface of the forward wall. In one embodiment of the invention, in which the forward wall is linked to the compartment bottom, this solution has the advantage that upon opening of the forward wall the trough shaped surface forming leaf spring comes to lie flat so that an unhindered access to the lowermost partial compartment is possible. Upon closing of the forward wall, on the other hand, the leaf spring again becomes automatically bent to form the trough shaped surface.

A banknote compartment of the previously mentioned kind can be directly built into a till, or can be made as an individual unit, or in combination with other similar banknote compartments can be made in the form of a module which can then be inserted into a till.

BRIEF DESCRIPTION OF THE DRAWINGS

Further features and advantages of the invention will be apparent from the following description which in combination with the accompanying drawings explains the invention by way of exemplary embodiments. The drawings are.

DETAILED DESCRIPTION OF THE PREFERRED EMBODIMENTS

Figure 1:
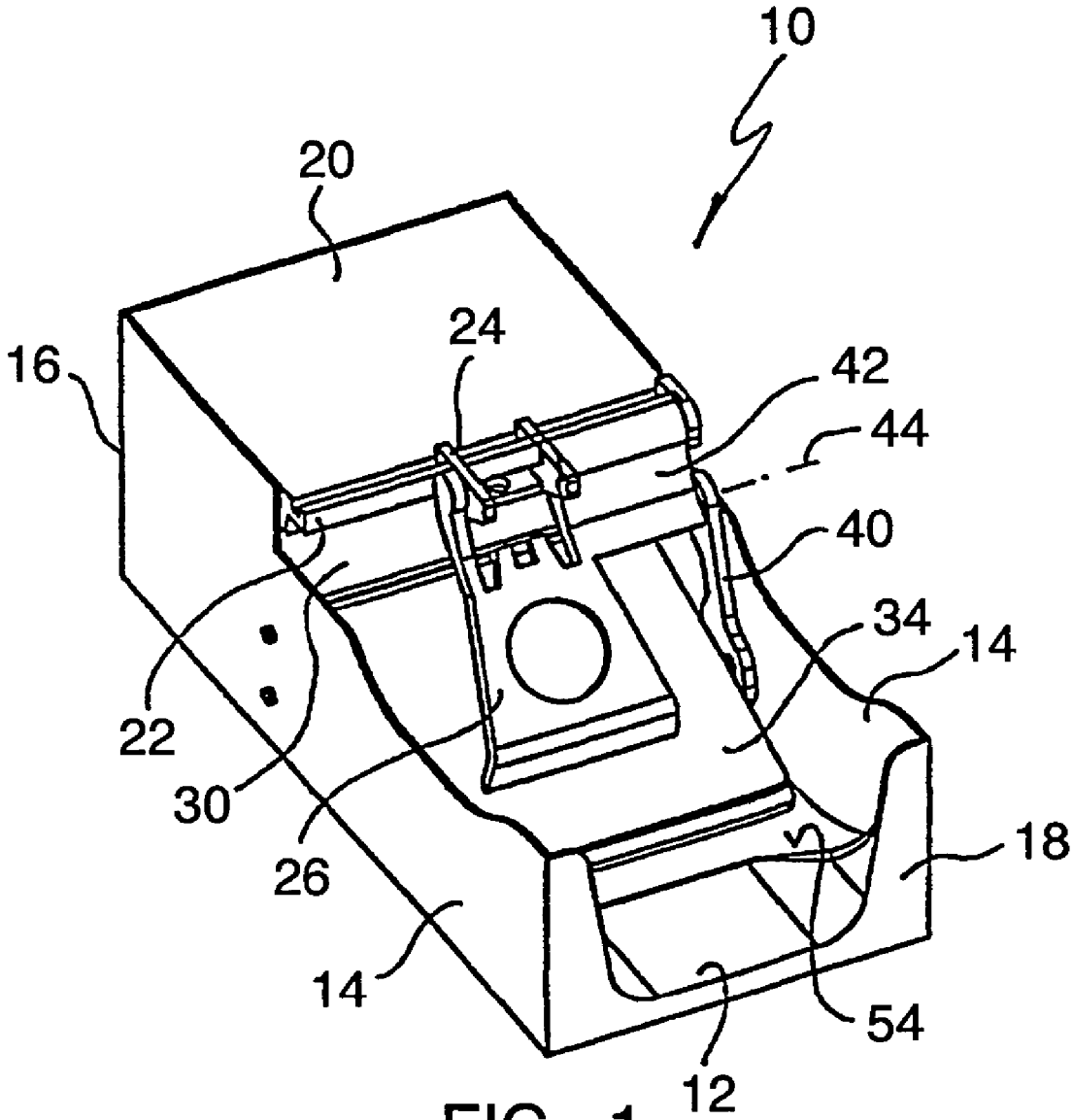
FIG. 1 is a partially schematic perspective view of a banknote compartment comprising till storage unit.

In FIG. 1 is seen a banknote compartment, indicated generally at 10, in the form of a unit to be inserted into a till. The banknote compartment has a box shaped form and includes a bottom 12, sidewalls 14, a rear wall 16 and a forward wall 18. A portion of the compartment proceeding from the rear wall 16 is covered by an upper cover 20, at the forward edge of which is formed a rail 22 onto which is hung a holding part 24 for a banknote hold-down clamp 26, as is described in EP-B-157 313. The hold-down clamp 26 is supported on the holding part 24 for pivotal movement about a pivot axis parallel to the longitudinal direction of the rail 22 and is biased by a non-illustrated spring means to its lower clamping position illustrated in FIG. 1. The hold-down clamp 26 can be pivoted away beyond a dead point to a stable lifted releasing position.

Between the compartment bottom 12 and the cover 20 is a first intermediate bottom indicated generally at 28, which has a fixed section 20 extending from the rear wall 16 and which is oriented somewhat in the middle between and parallel to the compartment bottom 12 and the cover 20. At the forward edge of the fixed section 30 is a movable section 34 of the intermediate bottom 20 which is pivotally joined to the fixed section 30 for movement about a pivot axis 32 arranged perpendicularly to the side wall 14. The intermediate bottom 28 divides the inner space of the banknote compartment 10 into a lower partial compartment 36 and an upper partial compartment 38, which can be used for the storage of banknotes of different kinds. The flap shaped movable section 34 is coupled with the hold-down clamp 26 by a coupling lever 40 for common pivotal movement. The coupling lever 40 is pivotally supported on a projection 42 of the hold-down clamp 26 for pivotal movement about a pivot axis 44 and has at its lower end a longitudinal hole 46 in which is received a pin 48 connected to the movable section 34.

Figure 2:
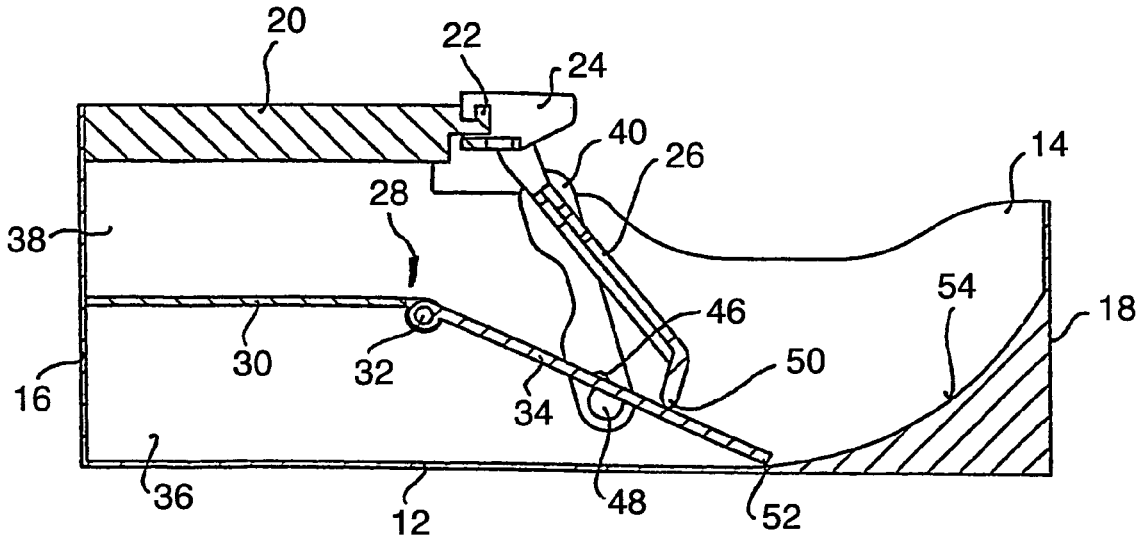
FIG. 2 is a schematic sectional view taken parallel to the side wall and perpendicular to the compartment bottom through a banknote compartment according to a first embodiment of the invention with the hold-down clamp in its clamping position.

In the position of the hold-down clamp 26 illustrated in FIG. 2, the hold-down clamp presses with its forward edge 50 onto the upper side of the movable section 34, so that this in turn is pressed by its forward edge 52 to the compartment bottom 12. Thereby banknotes in the partial compartments 36 and 38 are held fast by the flap 34 and the hold-down clamp 26 so that they cannot without anything further be taken out of the banknote compartment 10.

Figure 3:
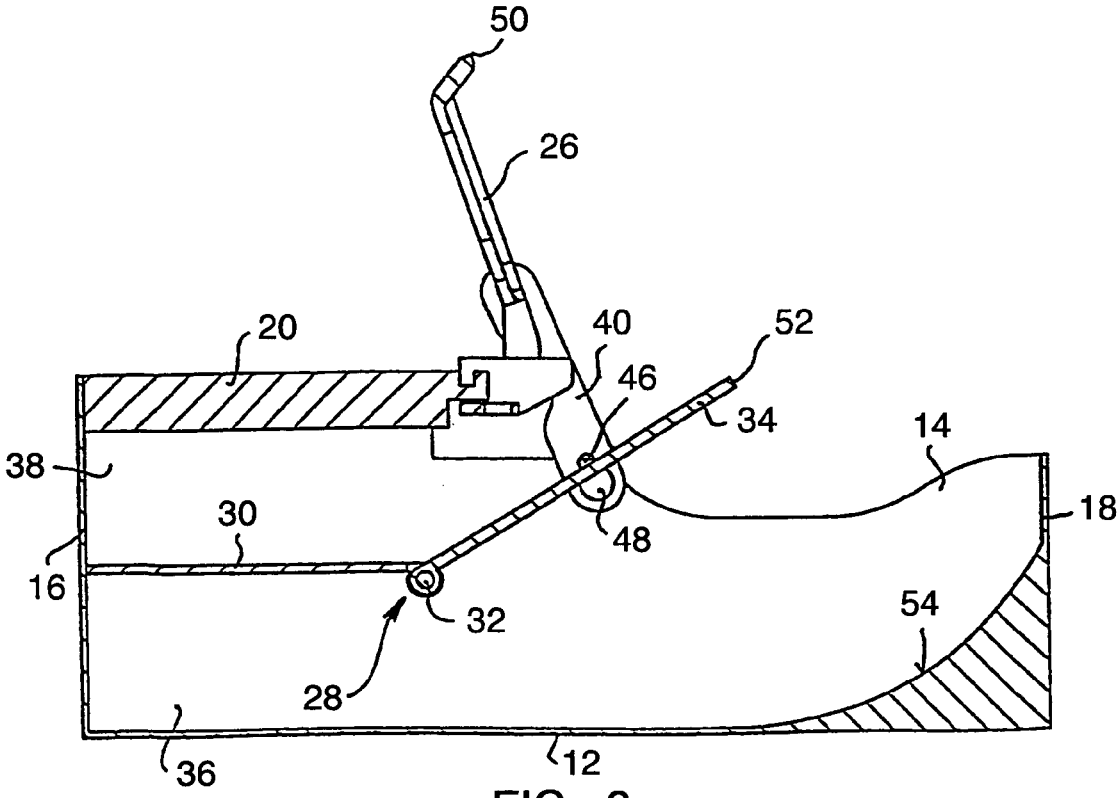
FIG. 3 is a sectional view corresponding to that of FIG. 2 with the hold-down clamp in its releasing position.

If the hold-down clamp 26 is pivoted to its upper releasing position as in FIG. 3, the flap 34 is likewise pivoted upwardly by the coupling lever 40. Access is in this way released to the banknotes aligned in the lower partial compartment 36, with the removal of the banknotes being facilitated by the formation of a curved trough shaped surface 54, which bridges the angle between the flat bottom 12 and the forward wall 18. The banknotes lying on the intermediate bottom of 28 become bent upwardly by the pivoting of the movable section 34 upwardly so that they likewise are easy to be taken hold of.

Figure 4:
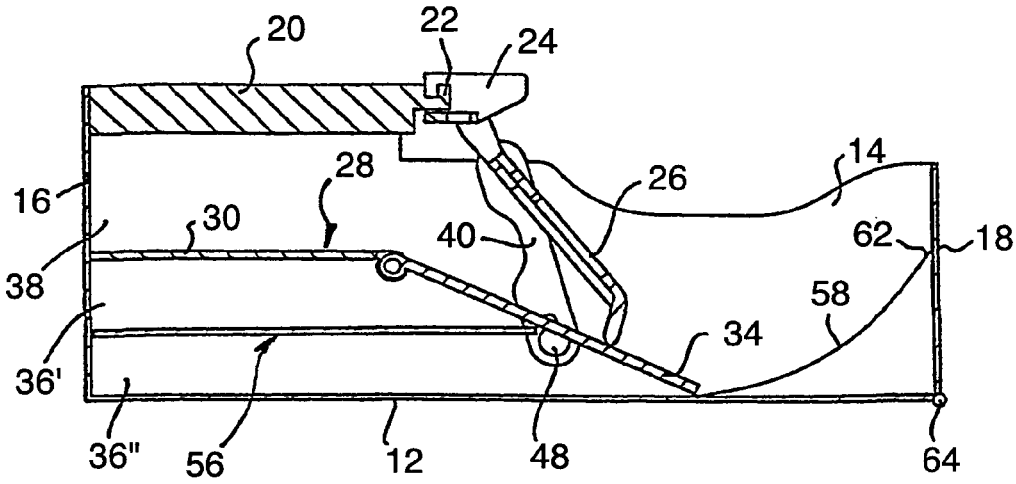
FIGS. 4 and 5 are views corresponding to those of FIGS. 2 and 3 illustrating a banknote compartment according to a second embodiment of the invention.
Figure 5:
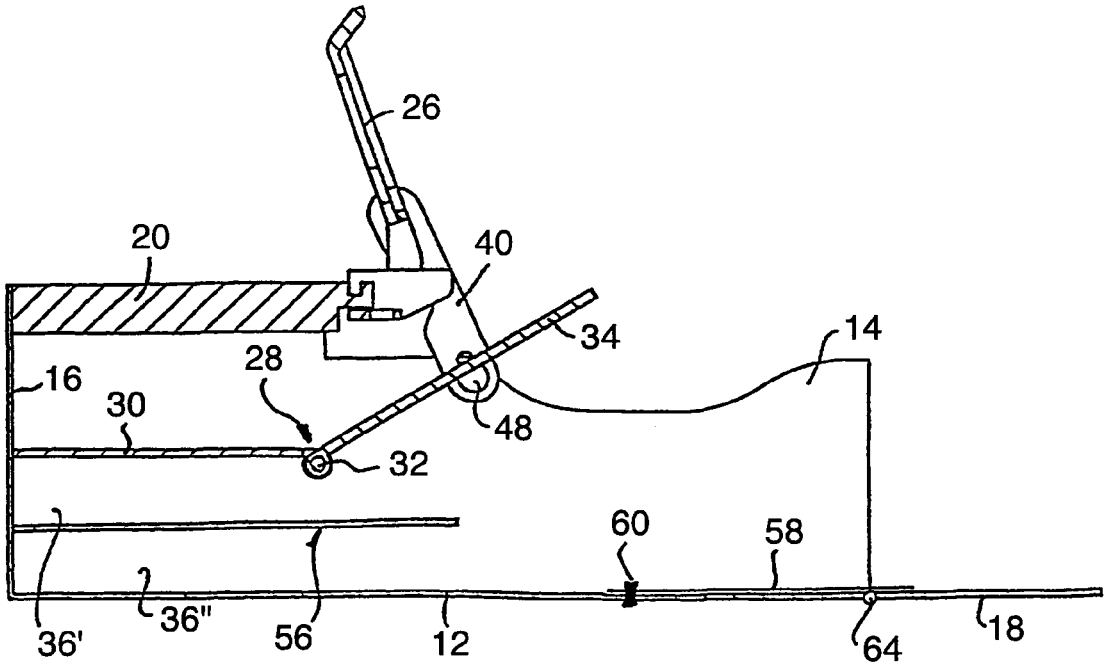

In the embodiment according to FIGS. 4 and 5 the same parts are again provided with the same reference characters. In this embodiment between the intermediate bottom 28 and the compartment bottom 12 is arranged further an intermediate bottom 56 which extends over a portion of the compartment length and in doing so projects somewhat beyond the fixed section 30 of the first intermediate bottom 28. The second intermediate bottom divides the partial compartment 36 again into further partial compartments 36' and 36".

As seen in FIG. 4 in the clamping position of the hold-down clamp 26 the movable section 34 covers the two partial compartments 36' and 36". In the releasing position illustrated at FIG. 5 of the hold-down clamp 26 access to the partial compartments 36' and 36" is released. In this case access to the lower partial compartment 36 is further enhanced in that the trough shaped surface 54 in the embodiment illustrated by FIGS. 4 and 5 is formed by a leaf spring 58 which at its rearward edge, that is its end 16 directed toward the rear wall 16, is fastened at 60 to the compartment bottom 12. The leaf spring 58 in the longitudinal direction of the compartment is longer than the spacing between the fastening point 60 and the forward wall 18. Thereby when the leaf spring 58 forms the curved trough shaped surface of 54 it lies with its forward edge 62 against the inner surface of the forward wall 18. This forward wall in the embodiment according to FIGS. 4 and 5 is linked to the bottom 12 about a pivot axis 64 perpendicular to the sidewalls 14 so that it can be flapped to an open position as seen in FIG. 5, when this is done the leaf spring 58 relaxes and lies flatly on the compartment bottom 12 and on the downwardly flat forward wall 18. In this way access to the lower partial compartments 36' and 36" is released. Upon upward flapping of the forward wall 18 into the position illustrated in FIG. 4 the leaf spring 58 is automatically taken along and transferred to its bent position.

Figure 6:
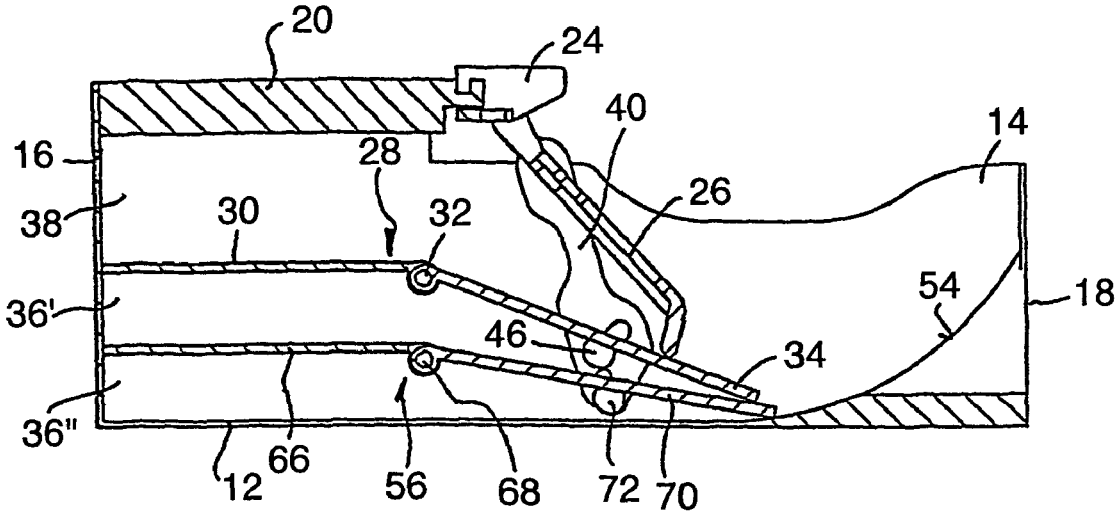
FIGS. 6 and 7 are views corresponding to those of FIGS. 2 and 4 illustrating a banknote compartment according to a third embodiment of the invention.
Figure 7:
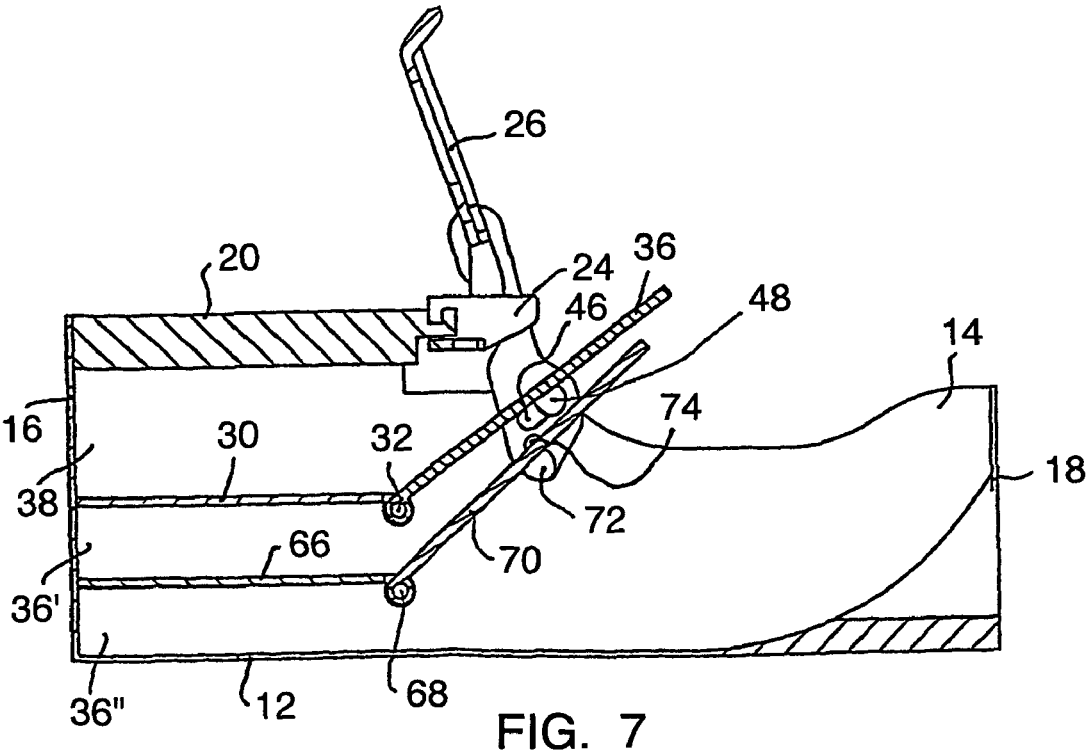

Another possibility for enhancing access to the lowermost partial compartment 36' and 36" is shown by the exemplary embodiment according to FIGS. 6 and 7 in which again similar parts are shown with the same reference characters. In this exemplary embodiment the second intermediate bottom 56 includes a fixed section 68 and a movable section 70 pivotally joined to the fixed section 66 for movement about an axis 68, with the movable section 70 likewise being coupled with the hold-down clamp 26 for common pivotal movement, for which a pin 72 connected with the movable section 70 is received in an elongated opening 74 formed in the coupling lever 40.

What is claimed is:

1. A banknote compartment for a till or the like, comprising:

a compartment bottom, sidewalls, a rear wall and a forward wall, and which compartment has a cover which proceeding from the rear wall extends over a portion of the compartment length which extends between the rear wall and the forward wall and which near its free end remotely from the rear wall has a free edge carrying a hold-down clamp for banknotes, which hold-down clamp is pivotal about an axis substantially parallel to the compartment bottom and the rear wall between a clamping condition, at which it is biased downwardly in the direction toward the compartment bottom, and a lifted releasing position, and further having an intermediate bottom and arranged substantially parallel to and spaced from the compartment bottom and the cover to divide the banknote compartment into partial compartments overlying one another, which intermediate bottom extends from the rear wall over a portion of the compartment length, characterized in that the intermediate bottom has a fixed section connected to the rear wall and a movable section, which movable section is linked to an edge of the fixed section remote from the rear wall for movement about an axis substantially parallel to the compartment bottom and the rear wall, and in that the movable section and the hold-down clamp are of such measurements that the hold down clamp in its clamping position lies with its free end on the movable section of the intermediate bottom and presses the movable section in the direction toward the compartment bottom.

2. A banknote compartment according to claim 1, wherein the movable section of the intermediate bottom the and the hold-down clamp are coupled to one another for pivotal movement in common.

3. A banknote compartment according to claim 1, wherein between the compartment bottom and the intermediate bottom is arranged a second intermediate bottom which is substantially parallel to and spaced fro the compartment bottom and the intermediate bottom, and which second intermediate bottom extends from the rear wall over a portion of the compartment length to form a further partial compartment.

4. A banknote compartment according to claim 3, wherein the second intermediate bottom is longer than the first intermediate bottom.

5. A banknote compartment according to claim 1, wherein the forward wall is movable between a closed position and an open position, in which open position it allows free access to one or more partial compartments.

6. A banknote compartment according to claim 5, wherein the forward wall is pivotal relative to the compartment bottom about an axis oriented perpendicular to the sidewalls.

7. A banknote compartment according to claim 3, wherein the second intermediate bottom has a fixed section connected to the rear wall and a movable section, which movable section is pivotal at an edge of the fixed section of the second intermediate bottom remotely from the rear wall about an axis parallel to the compartment bottom and to the rear wall.

8. A banknote compartment according to claim 7, wherein the movable section of the intermediate bottom is coupled with the hold-down clamp and with the movable section of the first intermediate bottom for pivotal movement in common.

9. A banknote compartment according to claim 1, wherein in the forward portion of the banknote compartment is formed a trough shaped surface which bridges the angle between the compartment bottom and the forward wall.

10. A banknote compartment according to claim 9, wherein the trough shaped surface is formed by a leaf spring which is fastened with its rear end to the compartment bottom and with its forward end lies against the inner surface of the forward wall.

11. A banknote compartment according to claim 1, wherein the banknote compartment is formed as a removable unit for a till.

* * * * *